US011286714B2

(12) United States Patent
Lei et al.

(10) Patent No.: US 11,286,714 B2
(45) **Date of Patent: *Mar. 29, 2022**

(54) WINDOW SHUTTER ACTUATION DEVICE

(71) Applicants: Zhenbang Lei, Guangdong (CN); Xingbang Lei, Guangdong (CN)

(72) Inventors: Zhenbang Lei, Guangdong (CN); Xingbang Lei, Guangdong (CN)

( * ) Notice: Subject to any disclaimer, the term of this patent is extended or adjusted under 35 U.S.C. 154(b) by 472 days.

This patent is subject to a terminal disclaimer.

(21) Appl. No.: 16/382,231

(22) Filed: Apr. 12, 2019

(65) Prior Publication Data

US 2020/0157880 A1 May 21, 2020

(30) Foreign Application Priority Data

Nov. 16, 2018 (CN) ..... 201821896275.8

(51) Int. Cl.
*E06B 9/322* (2006.01)
*B65H 75/48* (2006.01)

(52) U.S. Cl.
CPC ..... *E06B 9/322* (2013.01); *B65H 75/486* (2013.01); *E06B 2009/3225* (2013.01)

(58) Field of Classification Search
CPC ..... E06B 2009/3225; E06B 2009/3222; E06B 9/56; E06B 9/68; E06B 9/62; E06B 9/324; E06B 9/322
See application file for complete search history.

(56) References Cited

U.S. PATENT DOCUMENTS 2,250,106 A * 7/1941 Lorentzen ..... E06B 9/304 160/170
2,765,030 A * 10/1956 Bechtler ..... E06B 9/308 160/170
6,012,506 A * 1/2000 Wang ..... E06B 9/30 160/170
6,056,036 A * 5/2000 Todd ..... E06B 9/262 160/84.01
6,536,503 B1 * 3/2003 Anderson ..... E06B 9/262 160/170
6,571,853 B1 * 6/2003 Ciuca ..... E06B 9/322 160/170
6,752,195 B1 * 6/2004 Chou ..... E06B 9/324 160/178.1 R (Continued)

FOREIGN PATENT DOCUMENTS

CH 672658 A5 * 12/1989 ..... E06B 9/32
CN 107288523 A * 10/2017 ..... E06B 7/08
FR 2957966 A1 * 9/2011 ..... E06B 9/42

*Primary Examiner* — Johnnie A. Shablack

(57) ABSTRACT

A window shutter actuation device includes a cord for driving window shutter slats to move, a retracting mechanism for winding an end of the cord away from the window shutter slats, a brake mechanism arranged between the retracting mechanism and the window shutter slats for controlling a retracting or releasing speed of the cord, and a power mechanism for driving the retracting mechanism to rotate to wind the cord. The retracting mechanism includes a frame, a reel rotatably mounted to the frame for winding the cord, and a wheel arranged outside and adjacent to an end of the reel. The end of the cord wound on the reel passes about the wheel and then extends to the brake mechanism after extending from the reel.

11 Claims, 9 Drawing Sheets

(56) References Cited

U.S. PATENT DOCUMENTS 7,341,091 B2 * 3/2008 Nien ..... E06B 9/322 160/170
7,520,311 B2 * 4/2009 Drew ..... E06B 9/322 160/171
7,624,785 B2 * 12/2009 Yu ..... E06B 9/322 160/171
7,740,045 B2 * 6/2010 Anderson ..... E06B 9/322 160/84.05
8,511,364 B2 * 8/2013 Anderson ..... E06B 9/322 160/84.05
9,103,157 B2 * 8/2015 Mullet ..... E06B 9/72
9,366,077 B2 * 6/2016 Chen ..... E06B 9/304
9,670,724 B2 * 6/2017 Oakley ..... E06B 9/74
9,714,538 B2 * 7/2017 Huang ..... E06B 9/38
9,732,555 B2 * 8/2017 Morris ..... E06B 9/322
9,765,565 B2 * 9/2017 Morris ..... E06B 9/322
9,957,750 B2 * 5/2018 Lin ..... E06B 9/324
9,988,837 B2 * 6/2018 Defenbaugh ..... E06B 9/322
10,329,836 B2 * 6/2019 Lin ..... E06B 9/322
10,480,244 B2 * 11/2019 Chen ..... E06B 9/78
10,655,384 B2 * 5/2020 Foley ..... E06B 9/68
10,988,981 B2 * 4/2021 Lei ..... E06B 9/324
2006/0278348 A1 * 12/2006 Huang ..... E06B 9/322 160/170
2007/0272364 A1 * 11/2007 Liang ..... E06B 9/322 160/84.05
2008/0099159 A1 * 5/2008 Nien ..... E06B 9/30 160/170
2011/0277943 A1 * 11/2011 Lin ..... E06B 9/262 160/84.04
2012/0267060 A1 * 10/2012 Anderson ..... E06B 9/262 160/241
2013/0233499 A1 * 9/2013 Wu ..... E06B 9/322 160/218
2014/0014279 A1 * 1/2014 Defenbaugh ..... E06B 9/68 160/168.1 P
2014/0305601 A1 * 10/2014 Mullet ..... E06B 9/42 160/170
2015/0129142 A1 * 5/2015 Huang ..... E06B 9/262 160/370
2015/0136336 A1 * 5/2015 Huang ..... E06B 9/322 160/170
2015/0136892 A1 * 5/2015 Hung ..... E06B 9/322 242/397.5
2015/0275573 A1 * 10/2015 Huang ..... E06B 9/38 160/192
2016/0053533 A1 * 2/2016 Chen ..... E06B 9/324 160/173 R
2016/0201389 A1 * 7/2016 Oakley ..... E06B 9/322 160/368.1
2016/0208551 A1 * 7/2016 Huang ..... E06B 9/60
2016/0222722 A1 * 8/2016 Schulman ..... E06B 9/68
2016/0222723 A1 * 8/2016 Morris ..... E06B 9/322
2016/0281421 A1 * 9/2016 Huang ..... E06B 9/324
2016/0298385 A1 * 10/2016 Chen ..... E06B 9/324
2017/0081914 A1 * 3/2017 Wu ..... E06B 9/266
2017/0107075 A1 * 4/2017 Hung ..... E06B 9/32
2017/0298691 A1 * 10/2017 Yamagishi ..... E06B 9/582
2017/0356241 A1 * 12/2017 Lin ..... E06B 9/32
2018/0000273 A1 * 1/2018 Wu ..... A47H 11/06
2018/0155980 A1 * 6/2018 Hong ..... E06B 9/324
2018/0347269 A1 * 12/2018 Wang ..... E06B 9/38
2019/0063147 A1 * 2/2019 Cheng ..... E06B 9/322
2019/0106936 A1 * 4/2019 Huang ..... E06B 9/322
2019/0211624 A1 * 7/2019 Lei ..... E06B 9/60
2020/0024896 A1 * 1/2020 Lei ..... B65H 75/486
2020/0157879 A1 * 5/2020 Lei ..... E06B 9/305
2020/0157880 A1 * 5/2020 Lei ..... B65H 75/486

* cited by examiner

WINDOW SHUTTER ACTUATION DEVICE

BACKGROUND OF THE INVENTION

1. Field of the Invention

The present invention relates to window shutter technical field and, more particularly to a window shutter actuation device.

2. Description of Related Art

A window shutter actuation device is used for actuating slats of a window shutter to perform flipping or lifting, to realize the opening and closing operation of the window shutter. A current window shutter actuation device mainly includes a cord connected to the slats, a retracting mechanism for retracting the cord, and a brake mechanism for controlling a speed of retracting the cord. According to different positioning of window shutter products, the retracting mechanism may be manually operated by operators, or may be actuated by an automated power actuation mechanism. A cord of a current actuation device is directly extended into the brake mechanism after extending from the retracting mechanism. In use, it is easy to cause a great deviation of the position of the cord in the retracting mechanism, resulting in a change in the tightness of the cord winding, which eventually causes the flipping or lifting of the slats to be not in place, affecting the normal opening and closing of the window shutter.

SUMMARY OF THE INVENTION

Therefore, the technical problem to be solved by the embodiments of the present invention is to provide a window shutter actuation device, which is capable of effectively ensuring the tightness of a cord in a retracting mechanism.

To solve the above-mentioned technical problems, an embodiment of the present invention provides a window shutter actuation device including a cord for driving window shutter slats to move, a retracting mechanism for winding an end of the cord away from the window shutter slats, a brake mechanism arranged between the retracting mechanism and the window shutter slats for controlling a retracting or releasing speed of the cord, and a power mechanism for driving the retracting mechanism to rotate to wind the cord. The retracting mechanism includes a frame, a reel rotatably mounted to the frame for winding the cord, and a wheel arranged outside and adjacent to an end of the reel. The end of the cord wound on the reel passes about the wheel and then extends to the brake mechanism after extending from the reel.

Furthermore, the power mechanism includes at least one spring actuation box, and a transmission shaft for transmitting power between the at least one spring actuation box and the retracting mechanism. Each of the at least one spring actuation box includes a box body, a spring wheel and an output shaft mounted in the box body, and a planar scroll spring with two ends respectively wound on the spring wheel and the output shaft. The output shaft of a corresponding one of the at least one spring actuation box extends out of the box body and is connected to an end of the transmission shaft. An opposite end of the transmission shaft is connected to the reel of the retracting mechanism.

Furthermore, the power mechanism includes at least two spring actuation boxes each including an output shaft, and a transmission shaft. The at least two spring actuation boxes are connected end to end in an axial direction of the output shafts. An end of the output shaft of each spring actuation box extends out of the box body to form a plug, and an opposite end of the output shaft is concaved to form a socket. The plug of one of two neighboring spring actuation boxes is engaged in the socket of the other one of the two neighboring spring actuation boxes to realize transmission connection. An outer end of an output shaft of one of the two spring actuation boxes at the first and last ends is connected with an adapter. The adapter is connected to the corresponding end of the transmission shaft.

Furthermore, opposite ends of each spring actuation box respectively form a hook and a slot. The hook of one of two neighboring spring actuation boxes is engaged in the slot of the other one of the two neighboring spring actuation boxes, to connect the two neighboring spring actuation boxes together.

Furthermore, an end of each output shaft extends out of the corresponding box body to form a plug, and an opposite end of the output shaft is concaved to form a socket. The plug and the socket each is connected with an adapter. The adapter is connected to the corresponding transmission shaft.

Furthermore, an end of the adapter connected to the plug of the output shaft forms a socket engaged with the plug. An end of the adapter connected to the socket of the output shaft forms a plug engaged with the socket. Cross sections of the plugs and the sockets are matched and non-circular.

Furthermore, an end surface of the spring actuation box connected with the adapter is mounted with a cover. The cover defines a through hole, through which a corresponding end of the adapter extends. An end of the adapter adjacent to the box body forms a block located between an end surface of the box body and the corresponding cover.

Furthermore, opposite ends of the spring actuation box respectively form a hook and a slot. The covers respectively form a slot and a hook. The hook and the slot of the covers are respectively engaged with the slot and the hook of the box body.

Furthermore, each of the at least one brake mechanism includes a base, and a pressing plate rotatably mounted to the base through a rotation shaft. A side of the base facing the pressing plate forms a plurality of first friction axes, and a side of the pressing plate facing the base forms a plurality of second friction axes misaligned with the plurality of first friction axes. An end of the pressing plate away from the rotation shaft forms a fixing rod. The corresponding cord passed about the wheel and then extended to the brake mechanism extends between the plurality of first friction axes and the plurality of second friction axes, and is connected to the window shutter slats after passing about the fixing rod. When the window shutter slats are active, the pressing plate is actuated by the corresponding cord to rotate about the rotation shaft and between a clamping position and a release position. When the pressing plate is in the clamping position, the plurality of second friction axes actuates the corresponding cord to extend between the plurality of first friction axes and the plurality of second friction axes.

Furthermore, the brake mechanism is arranged outside an end of the reel opposite to the wheel.

By adopting the above-mentioned technical solutions, the beneficial effects of the inventive embodiment of the present invention are as follows. The embodiment of the present invention is provided with a wheel located outside an end of the reel, and an end of the cord is passed about the wheel and then extended into the brake mechanism after extending out of the reel. Therefore, it can be well ensured that the position of the cord on the reel will not be offset, and the tightness of the cord will not change, which allows the retracting mechanism to accurately move the window shutter slats to flip or lift in place when retracting or releasing the cord.

DETAILED DESCRIPTION OF THE INVENTION

The present application will be further described in detail below with reference to the accompanying drawings and specific embodiments. It should be understood that the following illustrative embodiments and illustrations are only used to explain the present invention and are not intended to limit the invention, and that the features of the embodiments and embodiments of the present application may be combined with each other.

Figure 1:
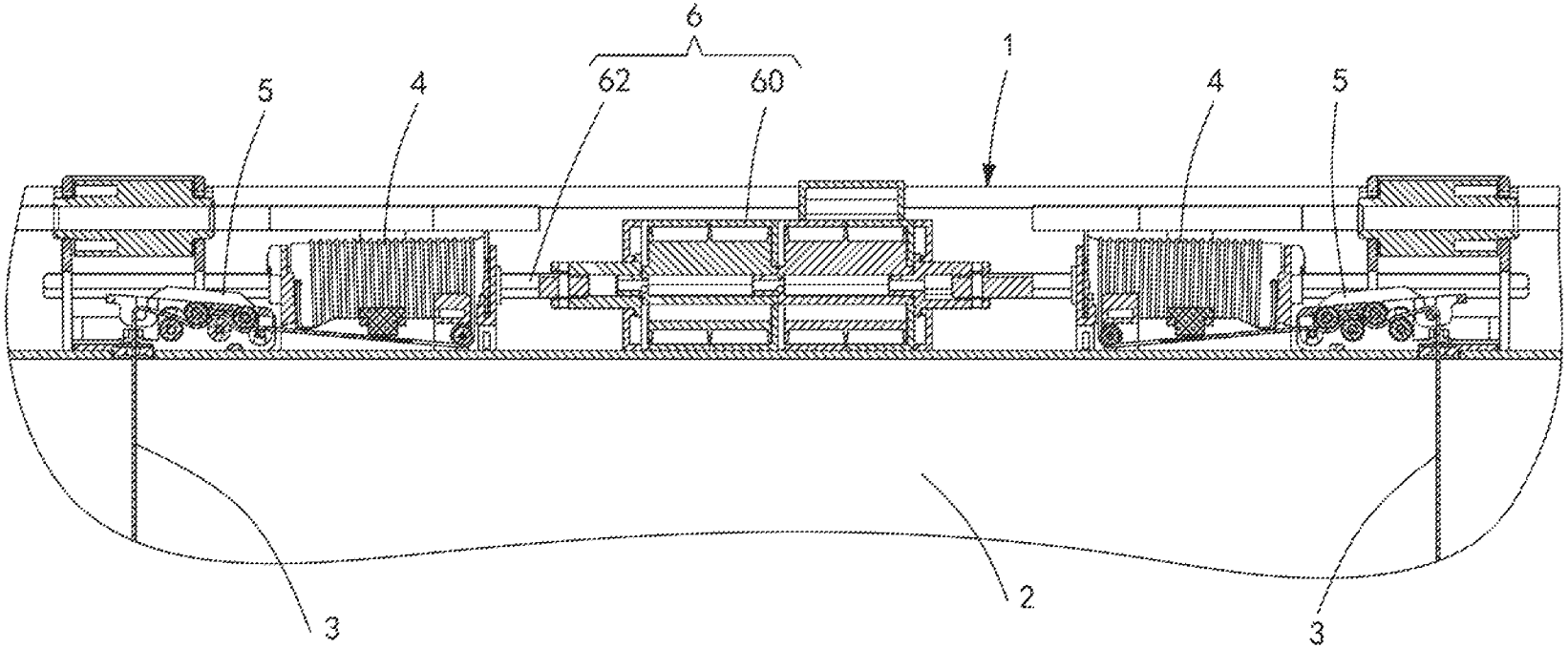
FIG. 1 is a cross-sectional view of a window shutter actuation device of an embodiment of the present invention, wherein the window shutter actuation device includes a retracting mechanism, a brake mechanism, and a power mechanism.

Referring to FIG. 1, an embodiment of a window shutter actuation device of the present disclosure includes a cord 3 for driving slats 2 of a window shutter 1 to move, a retracting mechanism 4 for winding an end of the cord 3 away from the slats 2, a brake mechanism 5 arranged between the retracting mechanism 4 and the slats 2 for controlling a retracting or releasing speed of the cord 3, and a power mechanism 6 for driving the retracting mechanism 4 to rotate to wind the cord 3.

Figure 2:
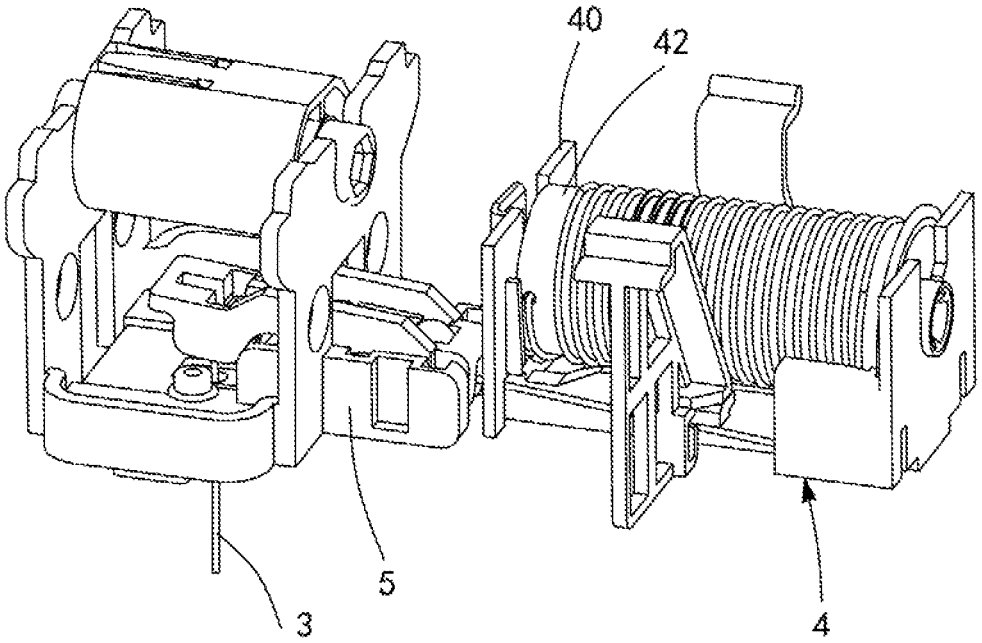
FIG. 2 is an assembled, isometric view of the retracting mechanism and the brake mechanism of FIG. 1.
Figure 3:
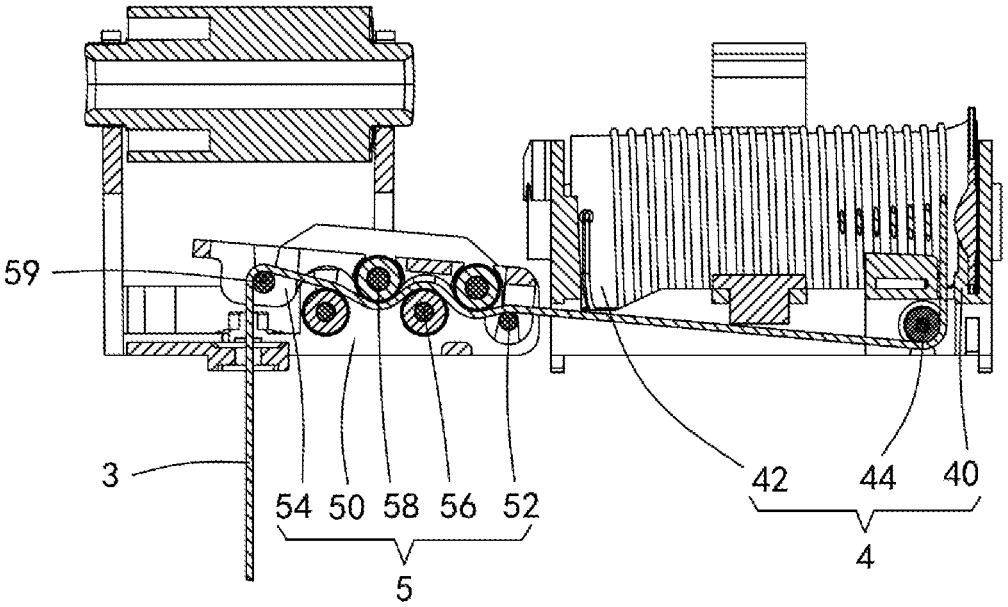
FIG. 3 is a cross-sectional view of FIG. 2.

Referring to FIGS. 2 and 3, the retracting mechanism 4 includes a frame 40, a reel 42 rotatably mounted to the frame 40 for winding the cord 3, and a wheel 44 arranged outside the reel 42 and adjacent to an end of the reel 42. An end of the cord 3 wound on the reel 42 passes about the wheel 44 and then extends to the brake mechanism 5 after extending from the reel 42.

In the embodiment, the wheel 44 is arranged outside and adjacent to the end of the reel 42, and the end of the cord 3 wound on the reel 42 is extended from the reel 42, extended about the wheel 44, and then extended to the brake mechanism 5. Therefore, it can be well ensured that the position of the cord 3 on the reel 42 does not be offset, and the tightness of the cord 3 wound on the reel 42 does not change, so that the retracting mechanism 4 can accurately move the slats 2 to flip or lift in place when retracting or releasing the cord 3.

Figure 6:
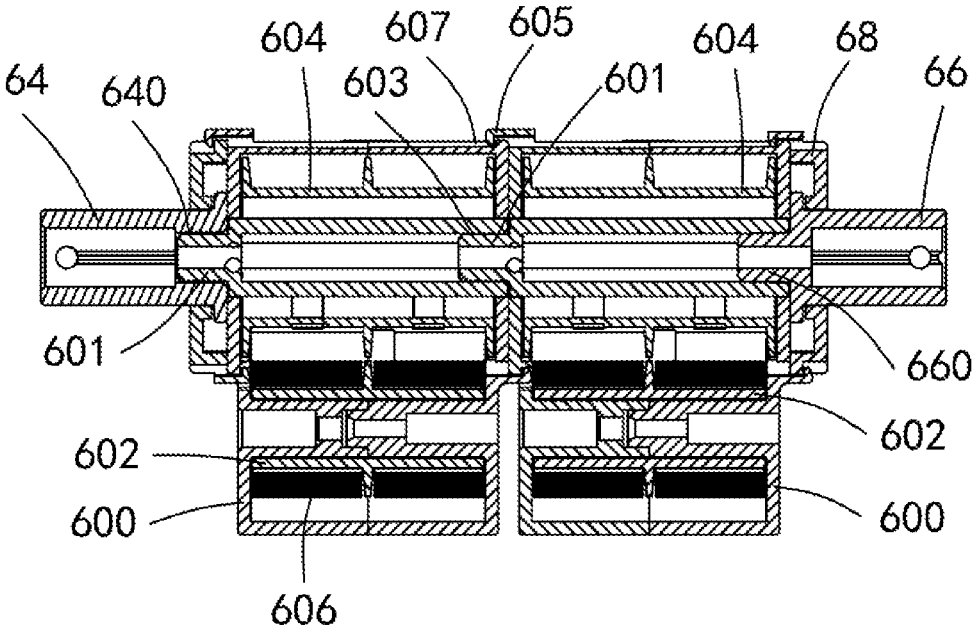
FIG. 6 is a cross-sectional view of FIG. 5.

Referring to FIGS. 1 and 6, in an alternative embodiment of the present disclosure, the power mechanism 6 includes a spring actuation box 60, and a transmission shaft 62 for transmitting power between the spring actuation box 60 and the retracting mechanism 4. The spring actuation box 60 includes a box body 600, a spring wheel 602 and an output shaft 604 mounted in the box body 600, and a planar scroll spring 606 with two ends respectively wound on the spring wheel 602 and the output shaft 604. The output shaft 604 extends out of the box body 600 and is connected to an end of the transmission shaft 62. An opposite end of the transmission shaft 62 is connected to the reel 42 of the retracting mechanism 4. In the embodiment, the spring actuation box 60 is provided with the planar scroll spring 606 as a core member to provide a rotational force, and is connected to the reel 42 of the retracting mechanism 4 through the transmission shaft 62, therefore, the characteristics of the planar scroll spring 606 can be used to provide the rotation power to drive the reel 42 to rotate, so as to control the cord 3.

Figure 4:
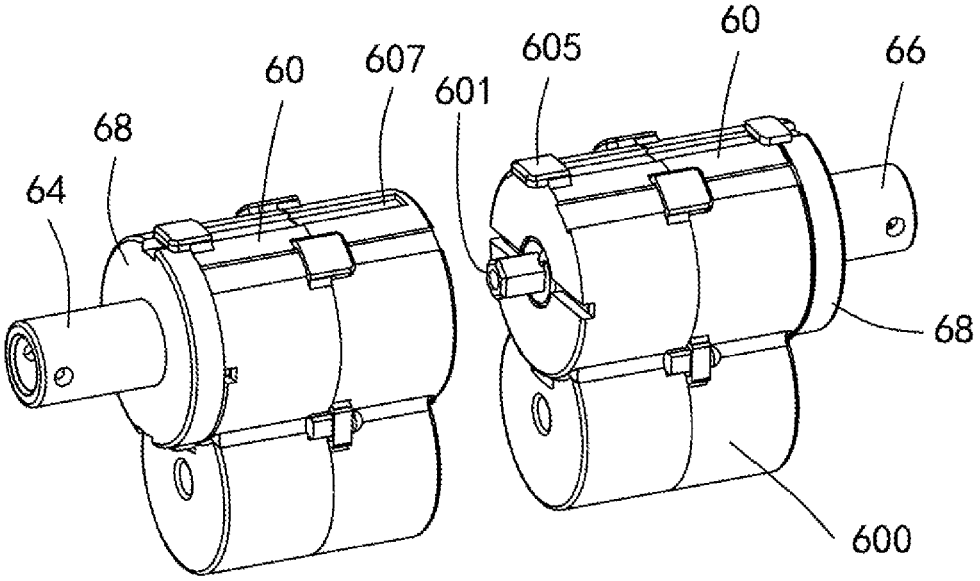
FIG. 4 is an isometric view of two separated spring actuation boxes of an embodiment of the power mechanism of FIG. 1.
Figure 5:
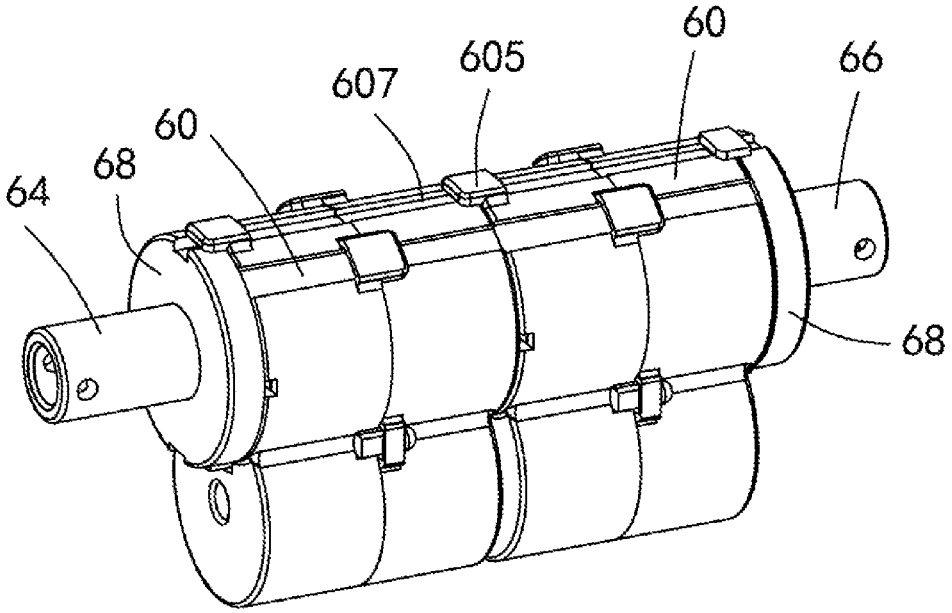
FIG. 5 is an assembled, isometric view of FIG. 4.

Referring to FIGS. 4-6, in an alternative embodiment, the power mechanism 6 includes at least two spring actuation boxes 60 as mentioned above. The at least two spring actuation boxes 60 are connected end to end in an axial direction of the output shaft 604. An end of the output shaft 604 of the spring actuation box 60 extends out of the box body 600 to form a plug 601, and an end surface of an opposite end of the output shaft 604 is concaved to form a socket 603. Two neighboring spring actuation boxes 60 realize the transmission connection through the plug 601 of the output shaft 604 of one of the spring actuation boxes 60 being engaged in the socket 603 of the output shaft 604 of an adjacent spring actuation box 60. Outer ends of the output shafts 604 of the two spring actuation boxes at the first and last ends are respectively connected with adapters 64 and 66. The adapters 64 and 66 are connected to the transmission shafts 62. In the embodiment, the at least two spring actuation boxes 60 are connected end to end, to jointly output rotation power. Two or more spring actuation boxes 60 can be connected according to actual needs, to better meet the driving force requirements of different specifications of window shutters. Two ends of the output shafts 604 of the spring actuation box 60 respectively form the plug 601 and the socket 603. Therefore, the plug 601 of at one end of the output shaft 604 of one spring actuation box 60 is directly engaged in the socket 603 of the corresponding end of the output shaft 604 of a corresponding one of the spring actuation box 60, and the transmission connection of the two spring actuation boxes 60 can be realized, which also facilitates the sequential connection of multiple spring actuation boxes 60.

In an alternative embodiment, two opposite ends of the box body 600 of the spring actuation box 60 respectively form a hook 605 and a slot 607. The hook 605 of one of two neighboring spring actuation boxes 60 is correspondingly engaged in the slot 607 of the other one of the two neighboring spring actuation boxes 60, so as to connect the two neighboring spring actuation boxes 60. In the embodiment, the ends of the box body 600 of the spring actuation box 60 form the hook 605 and the slot 607. Therefore, the spring actuation boxes 60 can be connected end to end in a convenient manner by using the snap fit of the hooks 605 and the slots 607, and the structure is simple and easy to do assembly and disassembly operation.

Figure 7:
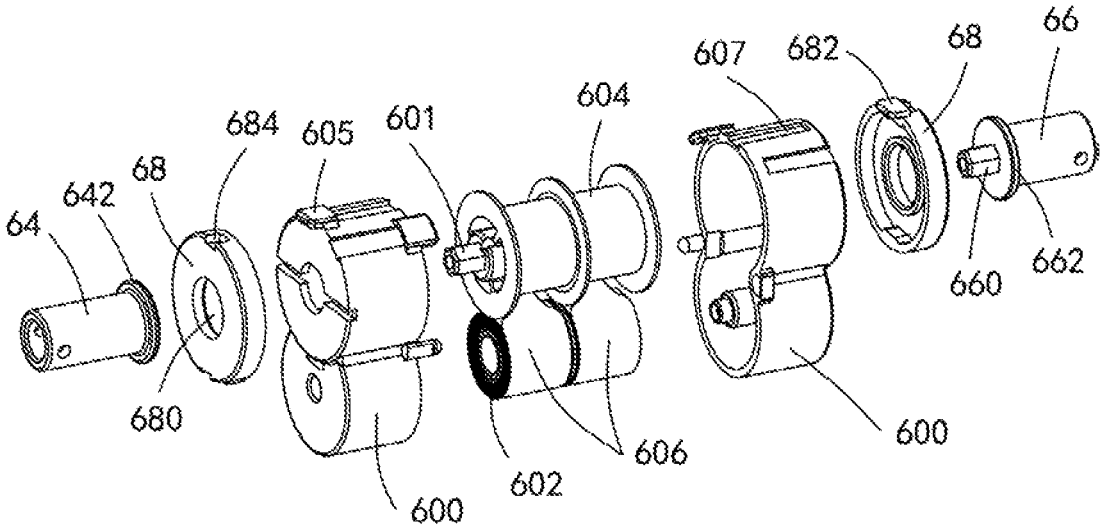
FIG. 7 is an exploded, isometric view of a spring actuation box of another embodiment of the power mechanism of the present invention.
Figure 8:
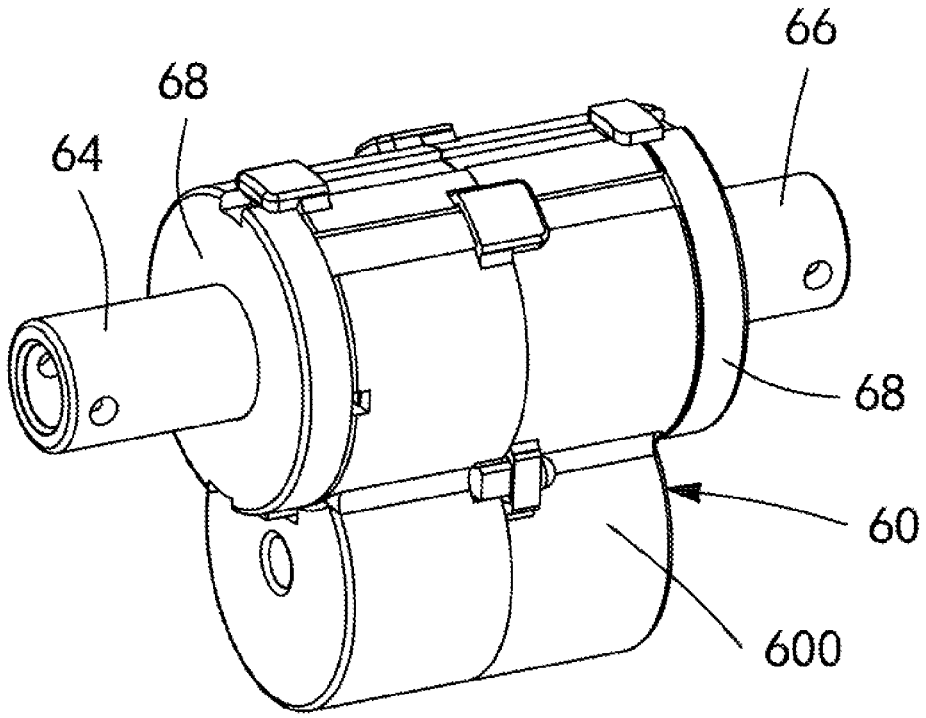
FIG. 8 is an assembled, isometric view of FIG. 7.
Figure 9:
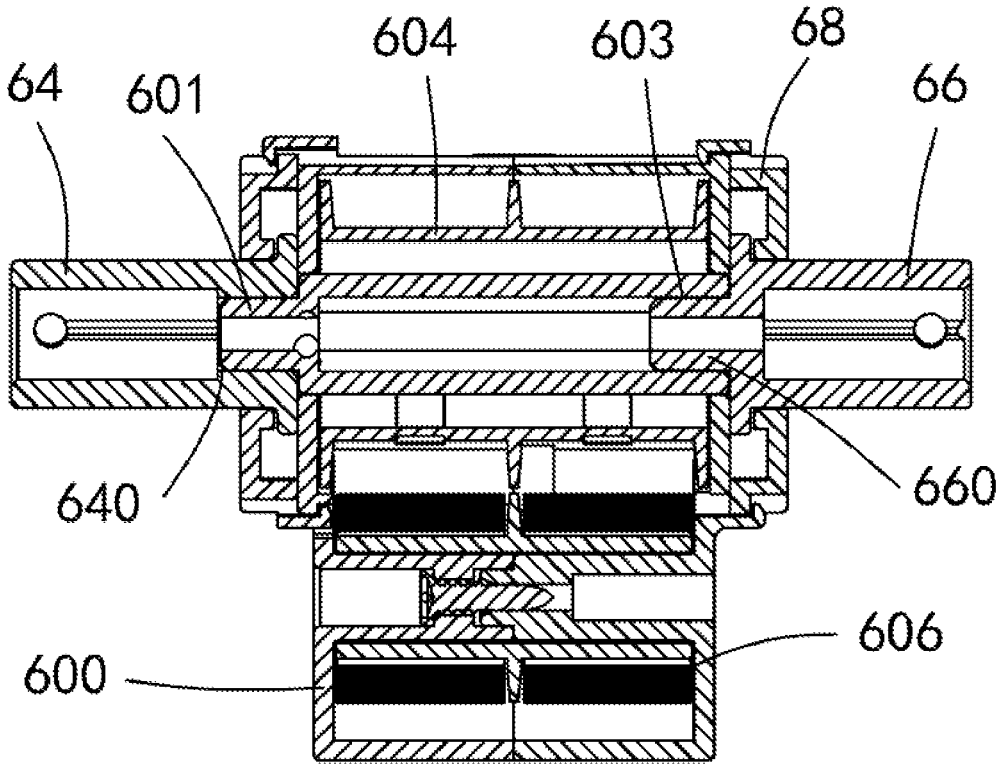
FIG. 9 is a cross-sectional view of FIG. 8.

In the embodiment illustrated in FIGS. 4-6, the power mechanism 6 includes at least two spring actuation boxes 60. When the required driving force is small, as with another alternative embodiment shown in FIGS. 7-9, only a single spring actuation box 60 is provided. An end of an output shaft 604 of the spring actuation box 60 extends out of a box body 600 of the spring actuation box 60 to form a plug 601, and an end surface of an opposite end of the output shaft 604 is concaved to form a socket 603. The plug 601 and the socket 603 of the opposite ends of the output shaft 604 are respectively connected to adapters 64 and 66. The adapters 64 and 66 are connected to the transmission shafts 62. In the embodiment, the opposite ends of the output shaft 604 respectively form the plug 601 and the socket 603, the plug 601 and the socket 603 are respectively connected to the adapters 64 and 66, and the adapters 64 and 66 are connected to the transmission shafts 62. Therefore, the overall structure is relatively simple and easy to manufacture and assemble.

Referring to FIGS. 6-9, in an alternative embodiment, an end of the adapter 64 connected to the plug 601 of the output shaft 604 forms a socket 640 to be correspondingly engaged with the plug 601, and an end of the adapter 66 connected to the socket 603 of the output shaft 604 forms a plug 660 to be correspondingly engaged with the socket 603. Cross sections of the plug 601, the socket 603, the socket 640, and the plug 660 are matched and non-circular, such as hexagonal, square, or elliptical. In the embodiment, the ends of the adapters 64 and 66 respectively form the sockets 640 and 660, and the cross sections of the plug 601, the socket 603, the socket 640, and the plug 660 are matched and non-circular. Therefore, on the one hand, the quick connection of the two components can be realized by plugging, and on the other hand, the transmission of the rotary power can be realized.

In an alternative embodiment, end surfaces of the box bodies 600 of the spring actuation boxes 60 respectively mounted with the adapters 64 and 66 are mounted with covers 68. The covers 68 define through holes 680, through which ends of the adapters 64 and 66 extend out. Ends of the adapters 64 and 66 adjacent to the box bodies 600 respectively form blocks 642 and 662 located between the end surfaces of the corresponding box bodies 600 and the corresponding covers 68. In the embodiment, the covers 68 are mounted to the end surfaces of the box bodies 600, so that the adapters 64 and 66 can be assembled more stably. Furthermore, the stability of the adapters 64 and 66 in the axial direction is limited by the blocks 642 and 662. Therefore, the adapters 64 and 66 transmit the rotary power more smoothly.

Referring to FIGS. 4-9, in an alternative embodiment, opposite ends of each of the box bodies 600 of the spring actuation boxes 60 respectively form a hook 605 and a slot 607. The covers 68 respectively form a hook 682 and a slot 684. The hook 682 and the slot 684 of the covers 68 are respectively engaged with the slot 607 and the hook 605 at the ends of the box bodies 600 mounted with the covers 68.

In an alternative embodiment, the brake mechanism 5 includes a base 50, and a pressing plate 54 rotatably mounted to the base 50 through a rotation shaft 52. A side of the base 50 facing the pressing plate 54 forms a plurality of first friction axes 56. A side of the pressing plate 54 facing the base 50 forms a plurality of second friction axes 58 misaligned with the first friction axes 56. An end of the pressing plate 54 away from the rotation shaft 52 forms a fixing rod 59. The cord 3 passed about the wheel 44 and then extended to the brake mechanism 5 extends between the first friction axes 56 and the second friction axes 58, and is connected to the slats 2 after passing about the fixing rod 59. When the slats 2 are active, the pressing plate 54 is actuated by the cord 3 to rotate about the rotation shaft 52 and between a clamping position and a release position relative to the base 50. When the pressing plate 54 is in the clamping position, the second friction axes 58 actuate the cord 3 to extend between the first friction axes 56 and the second friction axes 58. In the embodiment, the first friction axes 56 and the second friction axes 58 adopt misalignment settings, to allow the cord 3 to extend between the first friction axes 56 and the second friction axes 58, so as to apply sufficient frictional resistance to the cord 3 to control the releasing speed of the cord 3. The cord 3 is connected to the slats 2 after passing about the fixing rod 59, so during the process of releasing the cord 3, the tension of the cord 3 against the fixing rod 59 allows the pressing plate 54 to be better held in the clamping position relative to the base 50, which is similar to a self-locking effect.

In an alternative embodiment, the brake mechanism 5 is arranged outside the end of the reel 42 away from the wheel 44. In the embodiment, the brake mechanism 5 is arranged outside the end of the reel 42 away from the wheel 44, which is convenient for arranging the retracting mechanism 4 and the brake mechanism 5, so as to optimize the structural design of the entire window shutter actuation device.

The specific embodiments described above further explain the objectives, technical solutions, and beneficial effects of the present invention. It is to be understood that the foregoing description is only specific embodiments of the present invention, and is not intended to limit the scope of the present invention. Any modifications, equivalent substitutions, improvements made within the spirit and scope of the present invention are intended to be included in the scope of the present invention.

What is claimed is:

1. A window shutter actuation device, comprising:

a cord comprising a first end connected to window shutter slats of a window shutter, and a second end;

a retracting member connected with the second end of the cord;

a brake member arranged between the retracting member and the window shutter slats; and a power member connected to the retracting member to drive the retracting member to rotate to wind the cord;

wherein the retracting member comprises a frame, a reel rotatably mounted to the frame, and a wheel arranged outside and adjacent to an end of the reel, the first end of the cord extending from the reel passes about the wheel, extends through the brake member, and then is connected to the window shutter slats;

wherein the power member comprises at least one spring actuation box, and a transmission shaft for transmitting power between the at least one spring actuation box and the retracting member, each of the at least one spring actuation box comprises a box body, a spring wheel and an output shaft mounted in the box body, and a planar scroll spring with two ends respectively wound on the spring wheel and the output shaft, wherein the output shaft at an end of the at least one spring actuation box is connected with an adapter, the adapter is connected to an end of the transmission shaft, and an opposite end of the transmission shaft is coaxially connected to the reel.

2. The window shutter actuation device of claim 1, wherein the at least one spring actuation box comprises at least two spring actuation boxes; wherein the at least two spring actuation boxes are connected end to end in an axial direction of the output shafts of the at least two spring actuation boxes, an end of the output shaft of each of the at least two spring actuation boxes extends out of the box body to form a plug, and an opposite end of the output shaft is concaved to form a socket, the plug of one of two neighboring spring actuation boxes is engaged in the socket of the other one of the two neighboring spring actuation boxes to realize transmission connection, outer ends at opposite ends of the at least two spring actuation boxes each is connected with one adapter.

3. The window shutter actuation device of claim 2, wherein opposite ends of each of the at least two spring actuation boxes respectively form a hook and a slot, the hook of one of two neighboring spring actuation boxes is engaged in the slot of the other one of the two neighboring spring actuation boxes, to connect the two neighboring spring actuation boxes together.

4. The window shutter actuation device of claim 2, wherein an end of the adapter connected to the plug of the output shaft forms a socket engaged with the plug, an end of the adapter connected to the socket of the output shaft forms a plug engaged with the socket, cross sections of the plugs and the sockets are matched and non-circular.

5. The window shutter actuation device of claim 2, wherein an end surface of the spring actuation box connected with the adapter is mounted with a cover, the cover defines a through hole, through which a corresponding end of the adapter extends, an end of the adapter adjacent to the box body forms a block located between an end surface of the box body and the corresponding cover.

6. The window shutter actuation device of claim 1, wherein an end surface of the spring actuation box connected with the adapter is mounted with a cover, the cover defines a through hole, through which a corresponding end of the adapter extends, an end of the adapter adjacent to the box body forms a block located between an end surface of the box body and the corresponding cover.

7. The window shutter actuation device of claim 1, wherein another adapter is connected to the output shaft at an opposite end of the at least one spring actuation box, the output shaft at the one end of the at least one spring actuation box forms a plug, and the output shaft at the opposite end of the at least one spring actuation box forms a socket, the socket is connected with another adapter, an end of the adapter connected to the plug of the output shaft forms a socket engaged with the plug, an end of the adapter connected to the socket of the output shaft forms a plug engaged with the socket, cross sections of the plugs and the sockets are matched and non-circular.

8. The window shutter actuation device of claim 7, wherein opposite ends of the at least one spring actuation box respectively form a hook and a slot, two covers are respectively mounted to the opposite ends of the at least one spring actuation box, the covers respectively form a slot and a hook, the hook and the slot of the covers are respectively engaged with the slot and the hook of the box body.

9. The window shutter actuation device of claim 1, wherein the brake member comprises a base, and a pressing plate rotatably mounted to the base through a rotation shaft, a side of the base facing the pressing plate forms a plurality of first friction axes, a side of the pressing plate facing the base forms a plurality of second friction axes misaligned with the plurality of first friction axes, wherein an end of the pressing plate away from the rotation shaft forms a fixing rod, the cord passed about the wheel and then extended to the brake member extends between the plurality of first friction axes and the plurality of second friction axes; wherein when the window shutter slats are retracted or released, the pressing plate is actuated by the cord to rotate about the rotation shaft and between a clamping position and a release position; wherein when the pressing plate is in the clamping position, the plurality of second friction axes actuates the cord to extend between the plurality of first friction axes and the plurality of second friction axes.

10. The window shutter actuation device of claim 9, wherein the brake member is arranged outside an end of the reel opposite to the wheel.

11. The window shutter actuation device of claim 1, wherein the brake member is arranged outside an end of the reel opposite to the wheel.

* * * * *